United States Patent [19]

Carey et al.

[11] Patent Number: 5,030,114

[45] Date of Patent: Jul. 9, 1991

[54] SHIELD OVERCOAT

[75] Inventors: John J. Carey; Francis E. Noel, Jr., both of Durham, N.C.

[73] Assignee: International Business Machines Corporation, Armonk, N.Y.

[21] Appl. No.: 516,412

[22] Filed: Apr. 30, 1990

[51] Int. Cl.[5] ..... H01R 13/648

[52] U.S. Cl. ..... 439/92; 439/610

[58] Field of Search ..... 435/92, 188, 607, 609, 435/610

[56] References Cited

U.S. PATENT DOCUMENTS 4,759,729 7/1988 Kemppainen et al. ..... 439/188 X

FOREIGN PATENT DOCUMENTS 2098412 11/1982 United Kingdom ..... 439/609

*Primary Examiner*—Eugene F. Desmond

*Attorney, Agent, or Firm*—Joscelyn G. Cockburn

[57] ABSTRACT

An improved data connector includes identical hermaphroditic mating members having inner cable clamping ground shields coupled by a grounding plug to an outer ground shield. The outer ground shield is formed from two sleeves one of each mounted on one of the hermaphroditic mating members and overlapping each other to encircle the contact portions of the connector when it is in mated relationship with a complimentary member.

12 Claims, 5 Drawing Sheets

FIG. 2
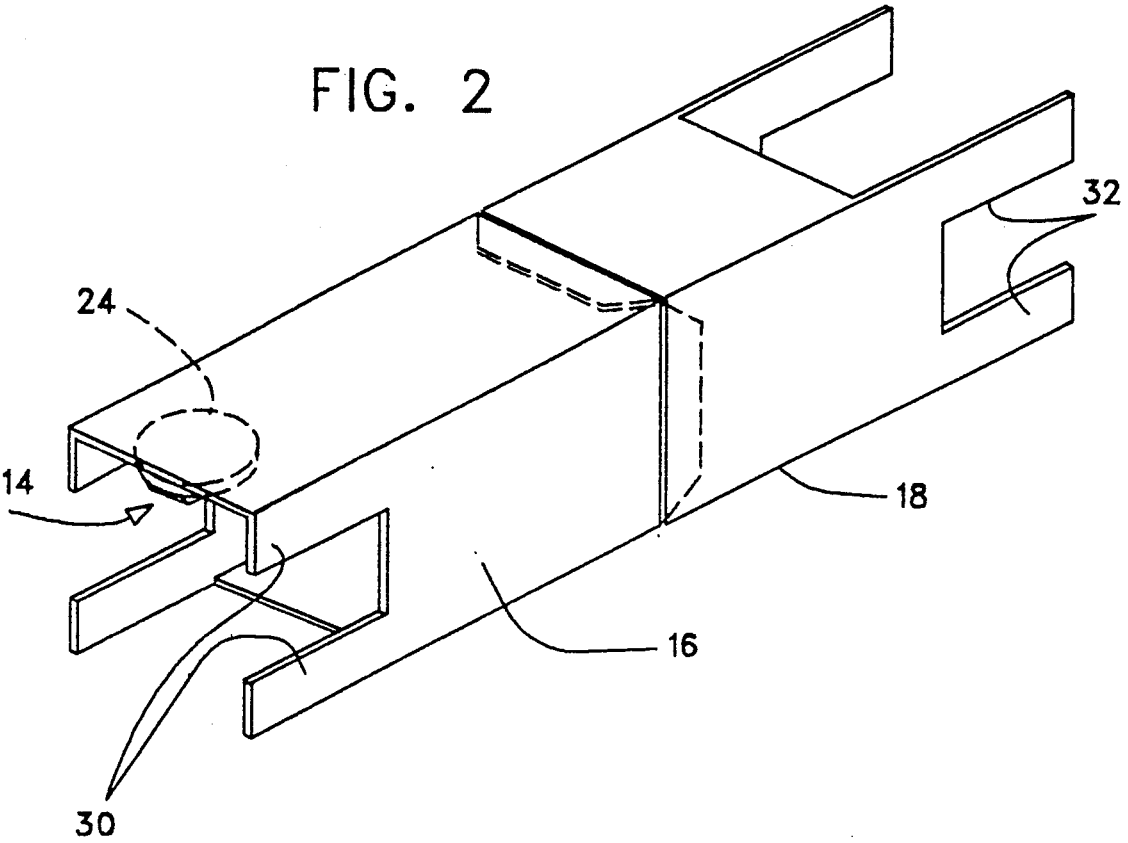
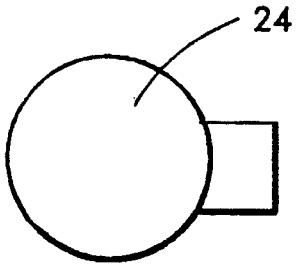
FIG. 3A
FIG. 3B
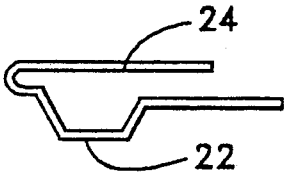
FIG. 3C
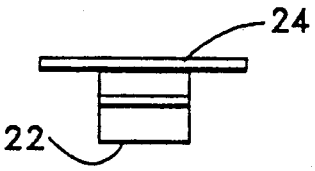

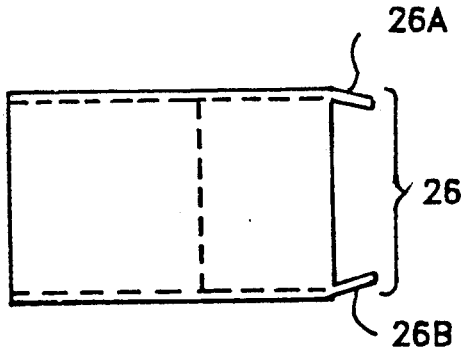
FIG. 4A
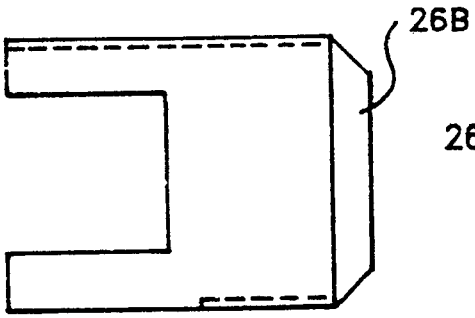
FIG. 4B
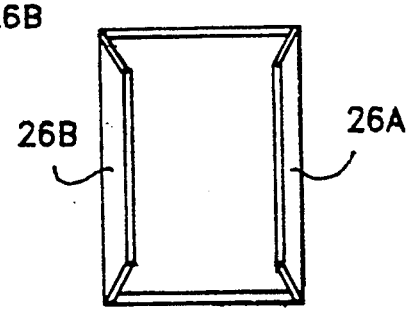
FIG. 4C
FIG. 5A
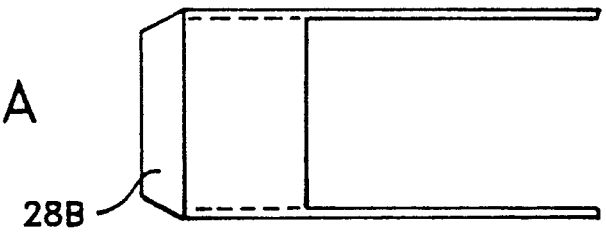
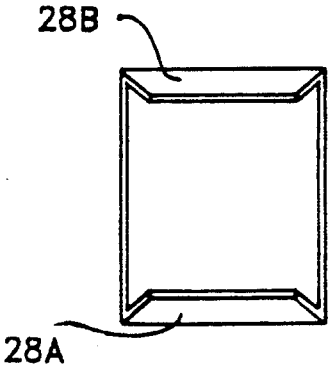
FIG. 5C
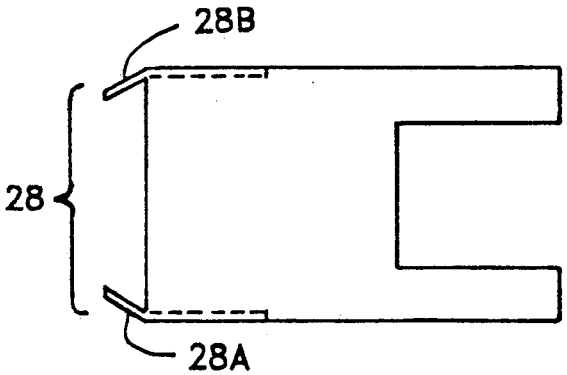
FIG. 5B

SHIELD OVERCOAT

BACKGROUND OF THE INVENTION

1. Field of the Invention

The present invention relates to electrical connectors in general and in particular to electrical connectors used in data communications systems.

2. Prior Art

Electrical connectors, hereinafter referred to as data connectors, are widely used in the communications industry. Usually, data connectors are used to attach data terminal equipment (DTE) to communications highways. DTE is a generic term which may include computers, printers, word processors, displays, etc. The data connectors transmit electrical signals representative of data between the DTE and the communications highway. In order to control radiation emission, the FCC and foreign governments have set radiation limits above which a product, such as the data connector, should not radiate. Failure to meet the set limits or standard could result in severe penalties.

U.S. Pat. No. 4,501,459 (Re. 32,760) describes a prior art data connector. With reference to FIG. 7 each member consists of a plurality of terminals 16 mounted in a terminal block 15. The connector consists of identical hermaphroditic mating members. The terminals have wire connecting sections and folded resilient contact sections (not shown) for mating with similar folded resilient contact sections of a complementary mating member. The terminal block 15 is mounted in a housing. The housing includes a non-conducting lower cover plate 12 which has a wire connecting end aligned with the wire connecting section of the terminals and an open end for mating with a similar lower cover plate of a complementary mating member, aligned with the contact sections of the terminals. A non-conducting upper cover member 11 co-acts with the lower non-conducting plate to form a casing about the terminals. A conductive upper ground shield 13 and a conductive lower ground shield 14 are provided with interlocking members and are placed inside of the upper and lower cover plates. The housing is open at the mating contact sections of the terminals and, except for an opening formed by 51 and 49, is closed at the wire connecting sections of the terminals. A shielded cable carrying a plurality of conductors is inserted through the opening. The conductors are each connected to the wire connecting section of a selected terminal and the cable shield 129 firmly connected to the ground shield via elements 65, 70 etc.

For EMI purposes, the prior art data connectors work well provided that the data rate is within the range of 4 Mb/sec. Whenever the data rate exceeds the 4 Mb/sec range, the radiation from the prior art data connector may exceed acceptable radiation limits.

SUMMARY OF THE INVENTION

It is a general object of the present invention to provide a data connector which transmits data at a relativelY high data rate and has acceptable radiation characteristics.

It is another object of the present invention to provide a kit which can be used to retrofit prior art data connectors so that the connectors may transmit data at a relatively high data rate, yet still have radiation levels that fall within acceptable limits.

These and other objects are achieved by providing improved EMI shielding for the data connector. The EMI shielding includes an inner conductive shield interconnected by a conductive member to an outer conductive shield. The inner and outer shields encircle the connectors and are coupled to the cable shield. Thus, a low level current conductive path is provided from the connector through the cable shield to ground potential.

In particular, if the kit is used to retrofit a data connector of the above described type an opening is made in the cover of one of the mating members of the hermaphroditic connector. The opening provides access to the internal metal casing which shields the terminals. A grounding plug is fitted into the opening. The plug has a section which firmly contacts the metal casing and a section which forms a seal for the opening and simultaneously contacts a metal sleeve which slides over the connector housing. Another metal sleeve is slid over the mating half of the hermaphroditic connector. The respective geometries of the sleeves are such that if the connector halves are in mating relationship, the sleeves are placed in an overlapping orientation over the juncture where the cover of the mating conductors meet.

Thus the shielding overcoat kit of the present invention can be used for in situ retrofitting installed data connectors or it can be included as components of a data connector kit. If included as part of a data connector kit, its installation is effected during the assembling of the data connector.

The foregoing features and advantages of the invention will be more fully described in the accompanying drawings.

BRIEF DESCRIPTION OF THE DRAWINGS

FIG. 2 is a perspective view of the shielding overcoat according to the teachings of the present invention.

FIG. 3A shows a top plan view of the grounding plug.

FIG. 3B shows a front elevational view of the grounding plug.

FIG. 3C shows a side elevational view of the grounding plug.

FIG. 4A is a top plan view of one of the two sleeves.

FIG. 4B is a front elevational view of said one of the two sleeves.

FIG. 4C is a side elevational view of said one of the two sleeves.

FIG. 5A is a top plan view of the other sleeve.

FIG. 5B is a front elevational view of the other sleeve.

FIG. 5C is a side elevational view of the other sleeve.

DETAILED DESCRIPTION

The shielding overcoat kit (to be described subsequently) can be used to improve the EMI characteristic of any data connector having internal EMI shield. It works well with the prior art connector set forth in FIG. 7 and, as such, is described in that environment. However, this should not be construed as a limitation on the scope of the present invention since it is well within the skill of one skilled in the connector art to make changes to the shield overcoat without departing from the scope of the present invention.

Figure 7:
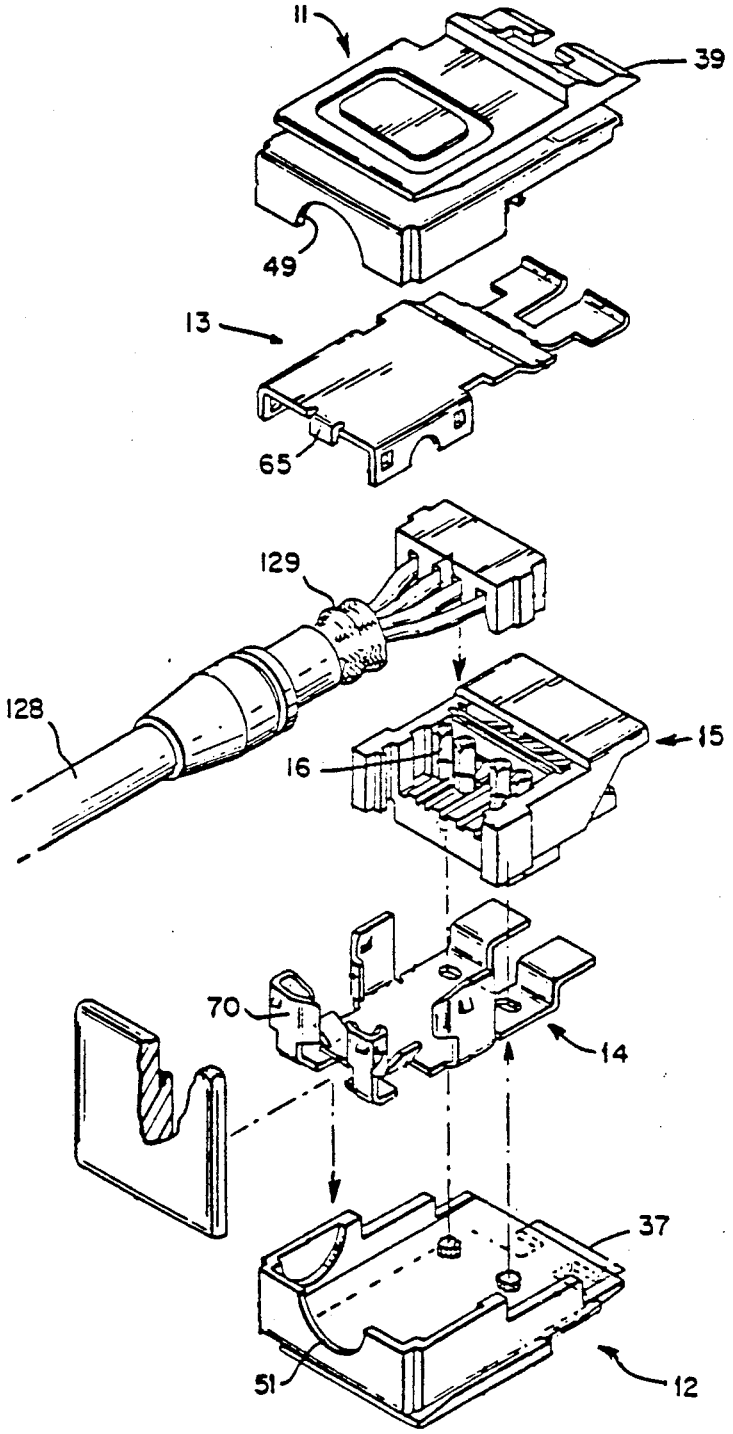
FIG. 7 PRIOR ART
FIG. 7 shows an exploded view of a prior art connector.

The prior art connector of FIG. 7 transmits data at higher data rates without unacceptable EMI problems if covered with the shield overcoat The shield overcoat can be attached to installed connectors without disassembling it or it could be part of a connector kit. It is believed that most of the RF radiation that leaks out of the connector is caused bY the disturbance of the electrical characteristics of cable 128 by adding the connector and the necessary altering of the cable shield. The cable is a balanced transmission line within a shield 129. The lay of the twisted pair conductors is disturbed, the symmetry is altered and the shield is interrupted to provide the mechanical connection function and still achieve the hermaphroditic design required of the connector. The balance of the twisted pair cannot be corrected without a major redesign of the connector, but the shield altering can be improved by the external shielding overcoat.

Figure 1:
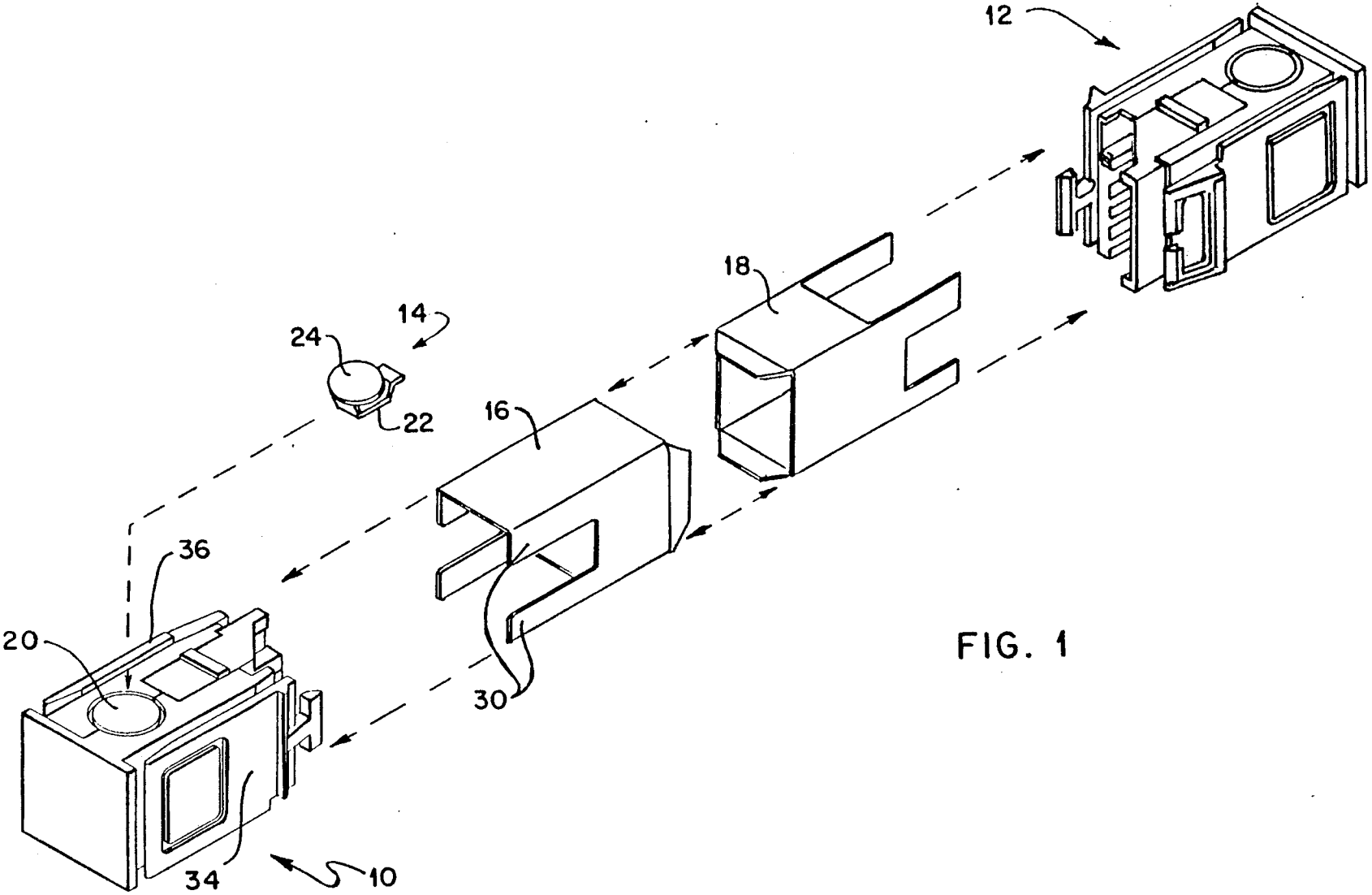
FIG. 1 is an exploded perspective view of the improved connector according to the teachings of the present invention.

FIG. 1 shows an exploded perspective view of the improved data connector according to the teachings of the present invention. The improved data connector includes hermaphroditic connectors 10, 12 and shield overcoat comprised of grounding plug 14, sleeve members 16 and 18. The overcoat is assembled to the hermaphroditic connectors by removing dust cover 20 and inserting the ground plug in its place. The ground plug is inserted so that contact section 22 is in contact with internal shielding member 13 which is coupled in turn to shield member 14 (FIG. 7). The section 24 of the grounding plug contacts the underside of sleeve member 16 when it is mounted to the hermaphroditic connector 10. Similarly, sleeve member 18 is mounted on hermaphroditic connector 12. When the connectors are in mating relationship, the mating front end of the sleeve members are configured in an overlapping relationship as is shown in FIG. 2. A conductive path is generated between the overlapping members 16 and 18 through the ground plug 14 to the internal shield 13 and 14 which is connected to cable shield 129 (FIG. 7).

FIGS. 3, 4 and 5 show different views of the shield overcoat members. FIG. 3 shows different views of the ground plug 14. FIG. 3A shows a top plan view of the plug. FIG. 3B shows a front view of the plug with elements 22 and 24. Finally, FIG. 3C shows a side view of the plug.

FIG. 4A shows a top plan view of sleeve 16. The mating end 26 has angled members 26A and 26B which are inclined relative to the sides of the sleeve member. FIG. 4B shows a front elevational view of sleeve member 16 while FIG. 4C shows a side elevational view.

FIG. 5 shows different views of sleeve member 18. FIG. 5A shows a top plan view of the sleeve member. FIG. 5B shows a front elevational view with the mating end 28 having angle members 28A and 28B, respectively. FIG. 5C shows a side elevational view of sleeve member 18.

With reference to FIG. 2, each of the sleeve members has slots such as slot 30 and 32 on opposite sides of each sleeve member. These slots allow each sleeve member to slide over its associated hermaphroditic connector between the connector housing and latching mechanism 34, 36, 38 and 40 (FIGS. 1 and 6) respectively. The dimensions of the overcoat sleeves can be selected based on the connector to be shielded and will depend on the size of the respective hermaphroditic connector. The respective size of the sleeve should be of different geometries so that one can slide over the other to provide the above described overlapping relationship at the mating ends. In one embodiment, the length of the sleeve measured along respective hermaphroditic connector is approximately 1.50" and the thickness is between 0.010 and 0.015 inches. Also, the material for the overcoat can be plated steel or any other conductive metal.

Figure 6:
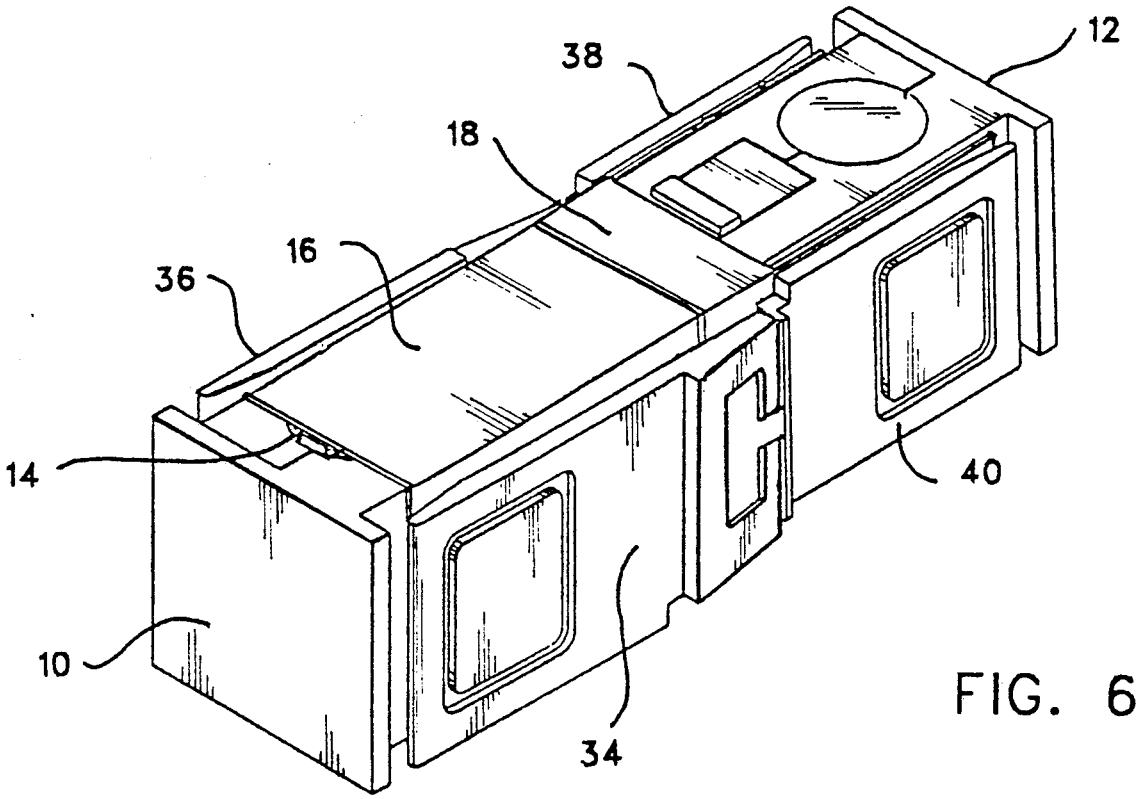
FIG. 6 is a perspective view of the improved connector.

FIG. 6 shows a pictorial view of the improved mated connectors 10 and 12 with overcoat members 16 and 18 and ground plug 14. By using a design that places a shield between the connector body and the latching and unlatching operated arms 34, 36, 38 and 40 of the connector, the shield can be slipped onto a connector without disassembly, even if it is mounted in a distribution panel (not shown). The external surface of the shield occupies a perimeter smaller than that of the connector's exterior dimensions, thereby allowing the shield to be slipped into place without disturbing the mounting of the connector. The shield covers the contact and intercontact area with 360° covering that is connected to the cable system ground by means of ground plug 14. The dust cover 20 and one of the mating connectors is removed and the grounding plug substituted in its place. The strap on the underside of the plug makes contact with the connector ground plane and the top of the plug makes contact with the overcoat that is slipped over the connector. The improved connector with inner and outer shield provides a connector which transmits data at very high rate yet still meets the EMI requirements.

While the invention has been particularly shown and described with reference to the preferred embodiment thereof, it will be understood by those skilled in the art that various changes in form and details may be made therein without departing from the spirit and scope of the invention.

What is claimed is:

1. An improved data connector comprising:

an insulative support means having a first face for mating with a complementary data connector and a second face for connecting conductors;

a plurality of terminals mounted in the insulative support means, said plurality of terminals having wire connecting ends aligned with the second face and mating ends for mating with terminals of a complementary data connector aligned with the first face;

an inner conductive shield means for grounding the data connector disposed to substantially surround the insulative support means and mounted terminals;

an insulative housing means connected to said insulative support means; said housing means operable for substantially surrounding the inner conductive means and covering and supporting components of said connector;

a movable conductive sleeve mounted to substantially surround an outside surface of the insulative housing means, said movable conductive sleeve separated from the inner conductive shield means by the insulative housing means and operable for contacting a complementary conductive sleeve when said connector is in a mated condition; and a grounding means interconnecting the inner conductive shield means and the outer conductive sleeve.

2. An improved data connector comprising:

an insulative support means having a first face for mating with a complementary data connector and a second face for connecting conductors;

a plurality of terminals mounted in the insulative support means, said plurality of terminals having wire connecting ends aligned with the second face and mating ends for mating with terminals of a complementary data connector aligned with the first face;

an inner ground shield means disposed adjacent to the insulative support means;

an insulative housing means connected to said insulative support means; said housing means operable for covering and supporting components of said connector;

an outer conductive sleeve mounted on the insulative housing means, said outer conductive sleeve operable for contacting a complementary conductive shield when said connector is in a mated condition;

a grounding means interconnecting the inner grounding shield and the outer conductive sleeve; and a cable connected to the data connector, said cable having a plurality of conductors one of each conductor being connected to the wire connecting end of a terminal and a shielding braid coupled to the inner ground shield.

3. A device for providing EMI shielding to a data connector comprising:

an inner conductive member which is an integral component and substantially surrounding other internal components of a first data connector;

a first movable sleeved member for mounting to the first data connector;

said first movable sleeved member being displaced from the inner conductive member; and a second movable sleeved member for mounting to a second data connector, said first movable sleeved member and said second movable sleeved member being oriented so that selective ends are overlapped if the first connector and second connector are in mating relation.

4. The device of claim 3 wherein the sleeved members are conductive.

5. The device of claim 4 further including a conductive means for interconnecting the first sleeved member and second sleeved member to the inner conductive member of said data connector.

6. In an electrical connector of the type comprising an insulative support block with a front mating face for mating with a complementary connector, a plurality of terminals mounted thereon with each terminal having a resilient contact tongue adjacent the front mating face, an inner conductive ground shield substantially encasing said insulative support block and an insulative housing connected to the support block, said housing substantially covering said inner conductive ground shield and having an open mating face adjacent said front mating face, a shielding overcoat for improving the EMI characteristics of said connector comprising:

a hollow conductive means for sliding over the insulative housing of said connector, said hollow conductive means having a mating face positioned adjacent to the front mating face; said mating face overlapping the mating face of a complementary hollow conductive means if said connector is in a mated condition with a complementary connector.

7. The electrical connector of claim 6 wherein the shielding means further includes a conductive ground plug having a section in contact with the inner conductive ground shield and a section in contact with the hollow conductive means.

8. The electrical connector of claim 6 wherein the hollow conductive means includes a rectangular shell having angled members connected at the mating face and angled towards the center of said rectangular shell.

9. The electrical connector of claim 8 wherein the approximate thickness of the shell is between 0.01 and 0.015 inches.

10. The electrical connector of claim 8 wherein the shell is fabricated from plated steel.

11. The electrical connector of claim 6 further including a conductive ground plug interconnecting the hollow conductive means and the inner conductive ground shield.

12. The electrical connector of claim 11 wherein the conductive ground plug function as a dust cover and conductor, simultaneously.

* * * * *